US006391083B1

(12) United States Patent
Akagi et al.

(10) Patent No.: US 6,391,083 B1
(45) Date of Patent: May 21, 2002

(54) MIXTURE FOR POWDER METALLURGY PRODUCT AND METHOD FOR PRODUCING THE SAME

(75) Inventors: Nobuaki Akagi; Shinya Kawai, both of Seymour, IN (US); Masaaki Satoh; Yoshikazu Seki, both of Takasago (JP); Masaki Amano, Powell; Hideaki Ushio, Dublin, both of OH (US); Russell T. Scott, Galloway, OH (US)

(73) Assignees: Kobeico Metal Powder of America, Inc., Seymour, IN (US); Kobe Steel, Ltd., Kobe; Honda Giken Kogyo Kabushiki Kaisha, Tokyo, both of (JP)

( * ) Notice: Subject to any disclaimer, the term of this patent is extended or adjusted under 35 U.S.C. 154(b) by 0 days.

(21) Appl. No.: 09/708,619

(22) Filed: Nov. 9, 2000

(51) Int. Cl.[7] ..... C22C 29/00

(52) U.S. Cl. ..... 75/231; 75/243; 75/246; 75/252; 419/10; 419/11; 419/28; 419/30

(58) Field of Search ..... 75/231, 246, 252, 75/243; 419/10, 11, 26, 28, 30

(56) References Cited

U.S. PATENT DOCUMENTS 5,501,728 A * 3/1996 Shepley et al. ..... 106/36
5,534,220 A * 7/1996 Purnell et al. ..... 419/45
5,571,305 A * 11/1996 Uenosono et al. ..... 75/246
5,631,431 A * 5/1997 Andersson ..... 75/230
5,679,909 A * 10/1997 Kaneko et al. ..... 75/246
5,938,814 A * 8/1999 Uenosono et al. ..... 75/254
6,264,718 B1 * 7/2001 Akagi et al. ..... 75/246

OTHER PUBLICATIONS

N. Akagi, et al., Advances in Powder Metallurgy & Particulate Materials–2000, pp. 6–1; 6–17; to 6–23, "MACHINABILITY AND FATIGUE PROPERTIES OF A PRE–ALLOYED, FREE CUTTING STEEL POWDER" May 30–Jun. 3, 2000.

Conference Abstract of Japanese Society or Powder Metallurgy, pp. 87 and 96, Oct. 18–20, 2000.

* cited by examiner

*Primary Examiner*—Ngoclan T. Mai
(74) *Attorney, Agent, or Firm*—Oblon, Spivak, McClelland, Maier & Neustadt, P.C.

(57) ABSTRACT

A mixture for a powder metallurgy product, including iron powder, graphite powder and copper (Cu) of about 3.0 to about 5.0 weight percent. Iron powder includes iron grains which contain MnS therein. The mixture contains the MnS of about 0.65 to about 1.40 weight percent. The graphite powder is contained in the mixture such that an amount of carbon (C) in the powder metallurgy product is about 0.3 to about 0.7 weight percent. An amount (wt % C) of the carbon and an amount (wt % Cu) of the copper is determined to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

16 Claims, 3 Drawing Sheets

FS MAP OF PRE-ALLOYED P/F MATERIAL

FS MAP OF PURE IRON P/F MATERIAL

MIXTURE FOR POWDER METALLURGY PRODUCT AND METHOD FOR PRODUCING THE SAME

BACKGROUND OF THE INVENTION

1. Field of the Invention

The present invention relates to a mixture for powder metallurgy product and a method for producing the mixture. Further, the present invention relates to a powder metallurgy product and a method for producing the powder metallurgy product.

2. Description of the Background

In powder metallurgy, after some kinds of powders are mixed at a predetermined ratio, the mixed powder is formed into a desired shape under pressure with die sets and then sintered to be a final metallurgy product.

One of the advantages of powder metallurgy products is that machining operation is unnecessary because powder metallurgy products having a substantially final shape may be formed in dies without machining operation. Recently, higher precision and more complex shapes have been required. Accordingly, machining operations have been required even for powder metallurgy products. However, generally, powder metallurgy products have poor machinability.

U.S. Pat. 5,938,814 and Japanese Examined Patent Publication (kokoku) 56-45964 (hereinafter referred to as the "'964 publication") disclose steel powder having good machinability. The contents of these references are incorporated herein by reference in their entirety.

In the steel powder disclosed in the '964 publication, the steel powder contains S of 0.15 to 0.5 weight percent (wt %) and Mn of at most an amount greater than a Mn/S balance amount by 0.3 weight percent. Mn is used for combining with S. MnS is not easily oxidized after Mn combines with S.

Generally, powder metallurgy products have inferior mechanical strength. The reason is presumed that powder metallurgy products have many pores therein, because powder metallurgy products are produced by being formed under pressure and being sintered.

SUMMARY OF THE INVENTION

An object of the present invention is to provide a powder metallurgy product which has improved machinability without substantially deteriorating fatigue strength.

According to one aspect of the invention, a mixture for a powder metallurgy product includes iron powder, graphite powder and copper (Cu) of about 3.0 to about 5.0 weight percent. Iron powder includes iron grains which contain MnS therein. The mixture contains the MnS of about 0.65 to about 1.40 weight percent. The graphite powder is contained in the mixture such that an amount of carbon (C) in the powder metallurgy product is about 0.3 to about 0.7 weight percent. An amount (wt % C) of the carbon and an amount (wt % Cu) of the copper is determined to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

According to another aspect of the invention, a powder metallurgy product which is made from a mixture which includes iron powder, graphite powder and copper (Cu) of about 3.0 to about 5.0 weight percent. Iron powder includes iron grains which contain MnS therein. The mixture contains the MnS of about 0.65 to about 1.40 weight percent. The graphite powder is contained in the mixture such that an amount of carbon (C) in the powder metallurgy product is about 0.3 to about 0.7 weight percent. An amount (wt % C) of the carbon and an amount (wt % Cu) of the copper is determined to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

According to yet another aspect of the invention, a method for producing a mixture for a powder metallurgy product includes depositing MnS in iron grains in iron powder; adding graphite powder to the iron powder such that an amount of carbon (C) in the powder metallurgy product is about 0.3 to about 0.7 weight percent; adding to the iron powder copper (Cu) of about 3.0 to about 5.0 weight percent; and determining an amount (wt % C) of the carbon and an amount (wt % Cu) of the copper to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

The mixture contains the MnS of about 0.65 to about 1.40 weight percent.

According to yet another aspect of the invention, a method for producing a powder metallurgy product includes producing a mixture during a mixture producing process; forming the mixture to a green compact under pressure; and sintering the green compact. The mixture producing process includes depositing MnS in iron grains in iron powder; adding graphite powder to the iron powder such that an amount of carbon (C) in the powder metallurgy product is about 0.3 to about 0.7 weight percent; adding to the iron powder copper (Cu) of about 3.0 to about 5.0 weight percent; and determining an amount (wt % C) of the carbon and an amount (wt % Cu) of the copper to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

The mixture contains the MnS of about 0.65 to about 1.40 weight percent.

According to the other aspect of the invention, a powder metallurgy product includes iron, carbon (C) of about 0.3 to about 0.7 weight percent, and copper (Cu) of about 3.0 to about 5.0 weight percent. The iron includes iron grains which contain MnS therein. The product containing the MnS of about 0.65 to about 1.40 weight percent. An amount (wt % C) of the carbon and an amount (wt % Cu) of the copper is determined to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DESCRIPTION OF THE PREFERRED EMBODIMENTS

The preferred embodiments will now be described with reference to the accompanying drawings.

Figure 1:
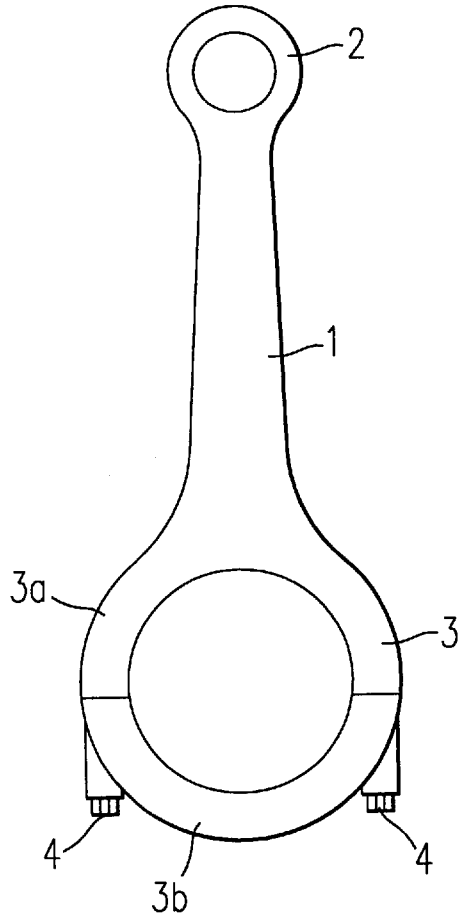
FIG. 1 is an elevational view of a connecting rod.

In powder metallurgy, after some elements are added to and mixed with iron powder, the mixture is formed under pressure with die sets to a green compact having a desired shape and then the green compact is sintered and forged to be a final metallurgy product. Such a metallurgy product is, for example, a connecting rod as shown in FIG. 1. The connecting rod 1 is used in, for example, an internal combustion engine of an automobile. The connecting rod 1 includes a small end portion 2 and a large end portion 3. The small end portion 2 is to be connected to a piston. The large end portion 3 is to be connected to a crank shaft. The large end portion 3 includes two half portions (3*a* and 3*b*) which are connected to each other via bolts 4.

Figure 2:
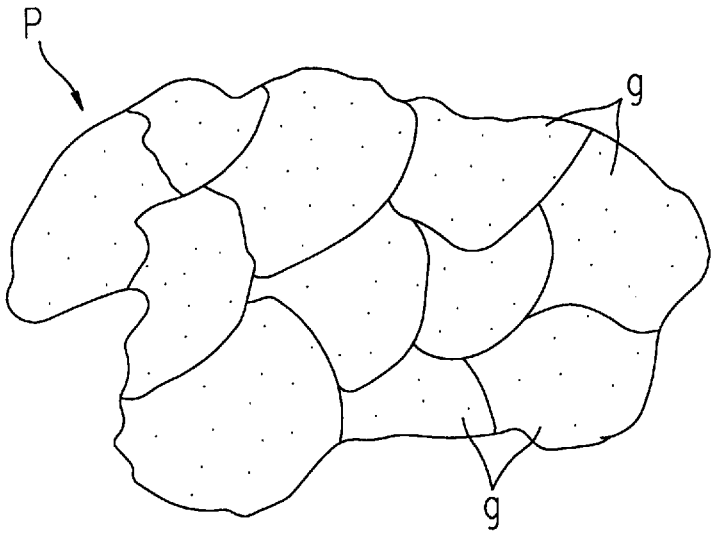
FIG. 2 is an enlarged cross sectional view of a particle (P) of MnS deposited iron powder.

In the present embodiment according to the present invention, a machinability improving element to improve machinability of a powder metallurgy product, for example, MnS, is deposited in iron grains of iron powder in order to improve the machinability of the powder metallurgy product. The iron powder includes a lot of iron particles. In the deposited iron powder, referring to FIG. 2, one iron particle (P) includes plural iron grains (g). MnS, which is shown by dot in FIG. 2, is substantially uniformly deposited in the iron grains (g).

In addition to MnS, elements for improving mechanical strength of powder metallurgy products, for example, Ni and/or Mo may be deposited in iron particles. Also Ni and/or Mo powders may be simply mixed with iron powder. Further, Ni and/or Mo may be combined with iron particles by diffusion bonding.

The inventors of the present invention studied the effect of amounts of copper and carbon on machinability and fatigue strength of the powder metallurgy product. For this study, several Fe—Cu—C mixtures were prepared using, as base powder, MnS deposited powder, pure iron powder and pure iron powder which MnS powder of 0.3 weight percent (wt %) was added to and mixed with. Table 1 shows the chemical compositions of the pure iron powder and MnS deposited powder by weight percent (wt %).

TABLE 1

| Powder | C | Si | Mn | S | [O] |
|---|---|---|---|---|---|
| Deposited Iron | 0.002 | 0.01 | 0.56 | 0.300 | 0.23 |
| Pure Iron | 0.001 | 0.01 | 0.20 | 0.010 | 0.16 |

In the production process of the deposited iron, manganese (Mn) and sulfur (S) are added into molten steel during melting and refining processes. Then, iron powder is produced during an atomizing process. Accordingly, MnS is deposited in iron grains. Japanese Examined Patent Publication (kokoku) 56-45964 discloses such a procedure. The contents of this reference are incorporated herein by reference in their entirety. Graphite powder and copper (Cu) are added to the iron powder. FIG. 2 shows an enlarged cross sectional view of one particle (P) of the MnS deposited iron powder. The particle (P) was etched by nital to be able to observe grain boundaries. MnS particles are substantially uniformly deposited all over the iron particle. The iron powder includes a lot of iron particles. In the deposited iron powder, referring to FIG. 2, one iron particle (P) includes plural iron grains (g). MnS, which is shown by dot, is substantially uniformly deposited in the iron grains (g).

Copper powder is screened by 150 Mesh (105 $\mu$m) and 90% of copper powder is pass through 200 Mesh (75 $\mu$m). Graphite (Gr) powder has 9.1 $\mu$m of D50 and 20.9 $\mu$m of D90. Lubricant (Lub) is selected from pure wax grade. MnS powder has 8.5 $\mu$m of D50 and 32.4 $\mu$m of D90. Mixtures are typical Fe—Cu—C composition.

All sample mixtures were formed to sample products which have a 90 mm outer diameter and a 45 mm height by using a uni-axis hydraulic press with 588 Mpa. These sample products were sintered at 1140° C. (2084° F.) during 40 minutes in a pusher type sintering furnace under pure nitrogen atmosphere.

Before pre-heating these samples for forging, graphite lubricant was coated on the surface of the sintered material to reduce frictions between sintered material and forging die wall and to prevent oxidation (or decarburization). Sintered materials are pre-heated at 1050° C. (1922° F.) during 30 minutes in a pre-heating furnace for forging. Forging was carried out with pressure of 980 MPa using a 1600 ton mechanical forging press.

(1) Fatigue Strength

JIS (Japanese Industrial Standard) 1 type rotating bending fatigue test specimens according to JIS Z 2274 of 1974 were prepared for measuring fatigue strength. The contents of JIS Z 2274 of 1974 are incorporated herein by reference in their entirety. Fatigue strength was measured according to Ono rotating bending fatigue method. The rotational speed was 3,600 rpm. Fatigue limit was defined as $10^7$ cycles.

(2) machinability

Machinability was determined by thrust force, i.e., during drilling. Reduction of the thrust force means improvement of machinability. Drilling conditions are as follows:

Drill: High speed steel drill having 5 mm diameter,

Speed: 800 rpm,

Depth of a drilling hole: 10 mm,

Feed rate: 0.05 mm/rev, and

Lubrication: No lubrication.

TABLE 2

| Base Powder | Sample No. | Cu % | C % | FS N/mm² | TS N/mm² | HRB | Thrust Kgf |
|---|---|---|---|---|---|---|---|
| Deposited Iron | 1 | 2.06 | 0.15 | 334 | 574 | 88.3 | 60 |
| | 2 | 2.04 | 0.35 | 343 | 662 | 94.1 | 56 |
| | 3 | 2.02 | 0.43 | 363 | 697 | 94.2 | 62 |
| | 4 | 2.57 | 0.43 | 373 | 739 | 96.2 | 62 |
| | 5 | 2.96 | 0.15 | 363 | 616 | 90.6 | 56 |
| | 6 | 2.97 | 0.43 | 373 | 792 | 97.9 | 67 |
| | 7 | 3.04 | 0.37 | 372 | 749 | 97.7 | 59 |
| Pure Iron + 0.3% Mns | 8 | 3.01 | 0.54 | 383 | 838 | 99.6 | 69 |
| | 9 | 1.98 | 0.44 | 343 | 729 | | 90 |
| | 10 | 2.10 | 0.65 | 372 | 890 | | — |
| | 11 | 2.98 | 0.45 | 353 | 840 | | — |
| | 12 | 3.09 | 0.65 | 382 | 999 | | — |
| | 13 | 2.05 | 0.45 | 333 | | | 71 |

Table 2 shows the chemical compositions of powder forged samples and the mechanical properties. Samples contained various combinations of copper (2–3 wt %) and carbon (0.2–0.6 wt %) to study their effect on machinability and fatigue strength. Some samples, such as 2 wt % Cu–0.45 wt % C (samples 3 and 9), and 3 wt % Cu–0.45 wt % C (samples 6 and 11) were equally comparable between the deposited and pure iron base materials. According to these comparisons, the deposited base material exhibited higher fatigue strength than pure iron base material. In Table 2, (FS) represents fatigue strength, (TS) represents tensile strength, and (HRB) represents hardness.

Comparing samples 3, 9 and 13 (Fe—2.0 wt % Cu—0.45 wt % C) as follows, the deposited iron powder exhibited higher fatigue strength by 20N/mm² than pure iron base (+30N/mm² against MnS admix base) and lower thrust force (better machinability) by 28 kgf than pure iron base (9 kgf lower than MnS admix base material) in the powder forged condition.

| Base powder | FS (N/mm²) | Thrust (kgf) |
|---|---|---|
| Pure Iron (No MnS) | 343 | 90 |
| Pure Iron +0.3% MnS | 333 | 71 |
| Deposited | 363 | 62 |

Referring to Table 2, the contribution of additives appears to be different between deposited and pure iron base material. To determine the additive effect on each property, regression analysis was done on both the deposited and pure iron powders for each mechanical property. Table 3 shows the coefficients for the following equation:

$$\text{Target property}=A\times(\text{wt \% Cu})+B\times(\text{wt \% C})+C \quad (1)$$

wt % Cu: weight percent of copper wt % C: weight percent of carbon

A and B: coefficients.

TABLE 3

| Deposited Iron | FS | TS | YP | HRB | Thrust |
|---|---|---|---|---|---|
| A | 22.61 | 75.28 | 65.47 | 2.993 | 2.01 |
| B | 66.63 | 525.66 | 234.43 | 22.960 | 22.81 |
| C | 280.84 | 326.60 | 294.95 | 78.912 | 47.99 |

TABLE 3-continued

| Pure Iron | FS | TS | YP | IV |
|---|---|---|---|---|
| A | 9.15 | 106.64 | 99.53 | −1.38 |
| B | 138.19 | 719.00 | 195.69 | −9.74 |
| C | 263.71 | 200.26 | 220.24 | 15.43 |

For fatigue strength (FS), the coefficient of copper for the deposited powder mixture was twice as large as that of the pure iron powder base mixture. The effect of carbon on (FS) in the deposited powder mixture was determined to be half as small as that of the pure iron powder base mixture. On the other hand, in case of tensile strength (TS), the additive contribution was about 70% for both copper and carbon on base versus pure iron base.

Based on this information, the additives not only have an effect on mechanical properties which was expected, but also behave differently in the different base powders as well.

Figure 3:
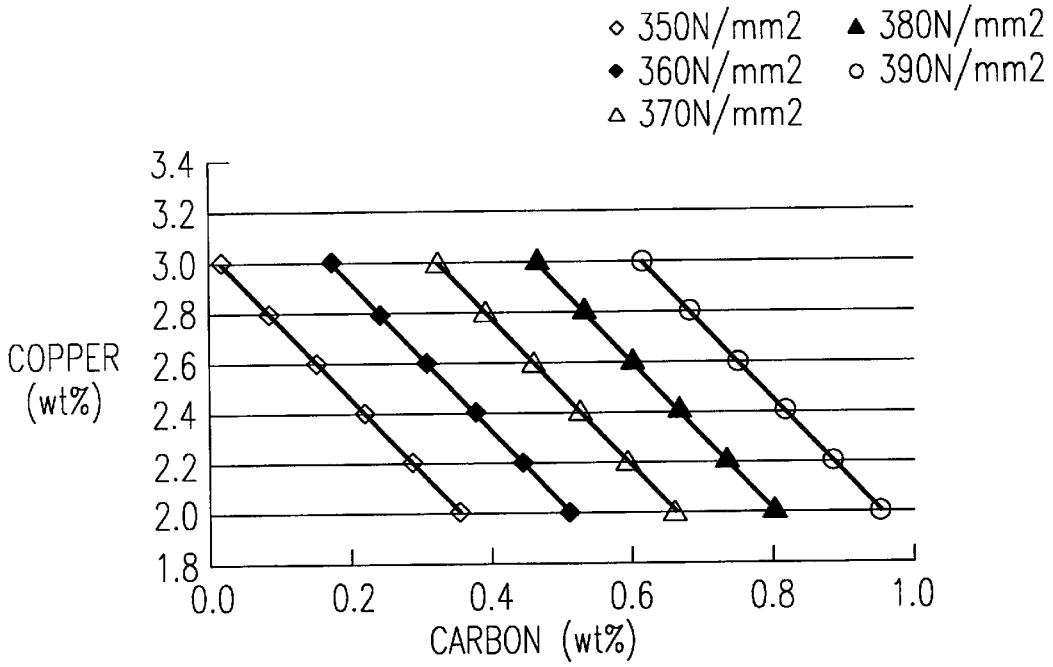
FIG. 3 illustrates a relationship between fatigue strength and amounts of carbon and copper in a powder metallurgy product which is made from MnS deposited iron based powder.
Figure 4:
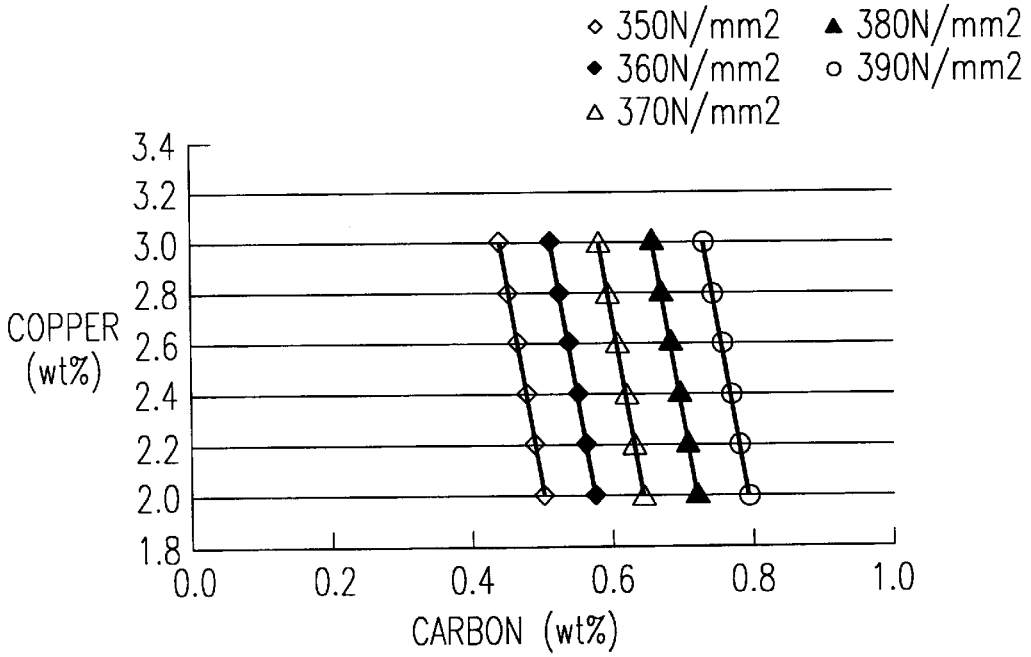
FIG. 4 illustrates a relationship between fatigue strength and amounts of carbon and copper in a powder metallurgy product which is made from pure iron based powder.

FIGS. 3 and 4 show the relationships between the amount of copper and the amount of carbon to obtain respective fatigue strengths according to the equation (1). Clearly, the fatigue strength of pure iron base powder forged (P/F) material was more sensitive to carbon content than deposited base powder forged material in the powder forging condition. This shows that pure iron base requires more precise carbon control during the entire manufacturing process than deposited base in order to get uniform properties. On the other hand, although the deposited base material is more sensitive than pure iron base to copper content, the contribution of copper is less than ⅓ that of carbon. It is known that there are several ways to prevent segregation of additives, such as the diffusion bonding method, organic binder treatment and so forth. These treated powders are effective at preventing segregation, but only in the green compact state. In the case of powder forged parts manufacturing, de-carburization will occur not only with the base powder oxygen, but also during sintering and forging. One of the benefits of the deposited powder for powder forging applications is that it has a lower sensitivity against carbon content.

In the pure iron based powder, it has been substantially impossible to increase the fatigue strength without deteriorating machinability. However, the inventors discovered that the fatigue strength may increase without deteriorating machinability by adjusting the amount of copper (wt % Cu) and the amount of carbon (wt % C). Machinability improves as hardness reduces. According to the equation (1) and Table 3, the inventors found the relationships between the fatigue strength FS (MPa) and the amounts of copper (wt % Cu) and carbon (wt % C), and between the hardness (HRB) and the amounts of copper (wt % Cu) and carbon (wt % C), as follows:

$$\text{Target Fatigue Strength (MPa)}=22.61\times(\text{wt \% Cu})+66.63\times(\text{wt \% C})+280.84$$

$$\text{Target Hardness (HRB)}=2.99\times(\text{wt \% Cu})+22.96\times(\text{wt \% C})+78.91.$$

The amounts of copper (wt % Cu) and carbon (wt % C) are determined to obtain a target fatigue strength FS (MPa) and a target hardness HR (HRB) based on the above relationship.

Figure 5:
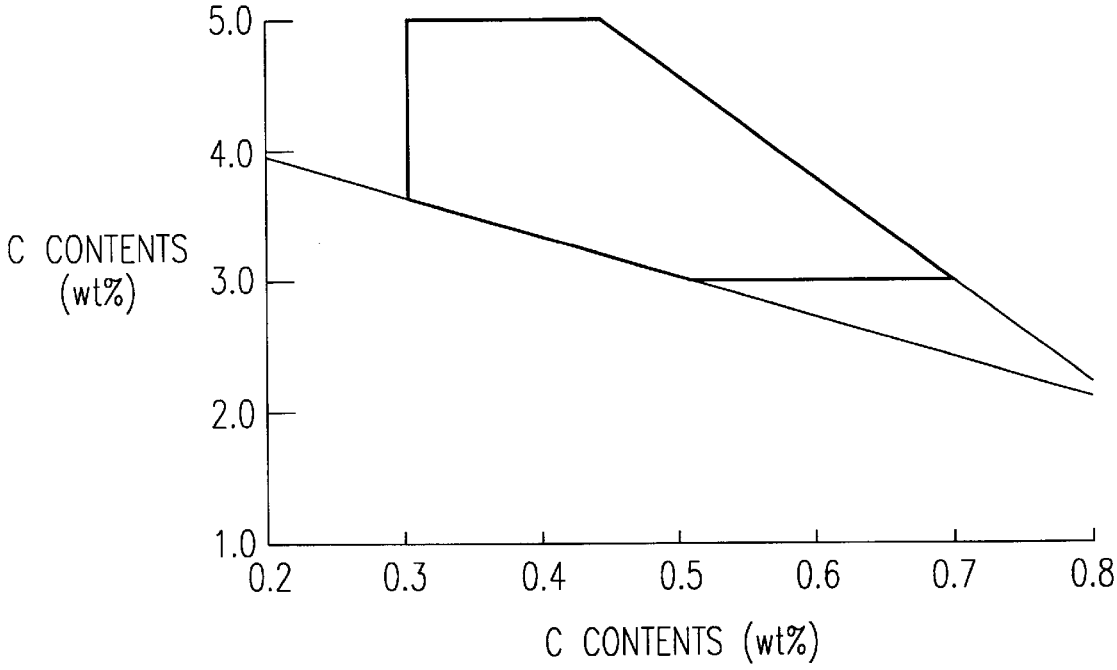
FIG. 5 illustrates relationships between the fatigue strength (MPa) and the amounts of copper (wt % Cu) and carbon (wt % C), and between the hardness (HRB) and the amounts of copper (wt % Cu) and carbon (wt % C).

FIG. 5 shows the relationships between the fatigue strength (MPa) and the amounts of copper (wt % Cu) and carbon (wt % C), and between the hardness (HRB) and the amounts of copper (wt % Cu) and carbon (wt % C). The line (F) represents the combination of amounts of C and Cu to obtain fatigue strength FS of 383 (MPa). Fatigue strength FS of more than 383 (Mpa) is obtained above the line (F). The line (H) represents the combination of amounts of C and Cu to obtain hardness HR of 104 (HRB). Hardness HR of less than 104 (HRB) is obtained below the line (H). To increase the fatigue strength without deteriorating machinability and without increasing cost, the amount of carbon (C) is about 0.3 to about 0.7 weight percent and the amount of copper (Cu) is about 2.0 to about 5.0 weight percent. Preferably, the amount of copper (Cu) is about 3.0 to about 5.0 weight percent.

In this powder, an amount of MnS which is deposited in the iron grain is about 0.65 to about 1.40 wt %. If the amount of MnS decreases less than about 0.65 wt %, the machinability deteriorates. On the other hand, if the amount of MnS increases more than about 1.40 wt %, the fatigue strength reduces. Preferably, the amount of MnS is about 0.65 to 1.00 wt %. In this range, the fatigue strength may increase without deteriorating the machinability and without substantially increasing cost. More preferably, the amount of MnS is about 0.65 to 0.90 wt %.

A mixture for powder metallurgy includes iron powder, graphite powder and copper (Cu) of about 2.0 to about 5.0 weight percent. Preferably, the amount of copper (Cu) is about 3.0 to about 5.0 weight percent. The iron powder includes iron grains which contain MnS therein. The mixture contains the MnS of about 0.65 to about 1.40 weight percent. Graphite powder is added to the mixture such that a carbon amount in a powder metallurgy product is about 0.3 to about 0.7 weight percent. An amount (wt % C) of the carbon and an amount (wt % Cu) of the copper is determined to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

Copper powder is screened by 150 Mesh (105 $\mu$m) and 90% of copper powder is pass through 200 Mesh (75 $\mu$m). Graphite (Gr) powder has 9.1 $\mu$m of D50 and 20.9 $\mu$m of D90. Lubricant (Lub) is selected from pure wax grade. MnS powder has 8.5 $\mu$m of D50 and 32.4 $\mu$m of D90. Mixtures are typical Fe—Cu—C composition.

Mixture is formed to green compacts which have a desired shape. The green compact is sintered at 1140° C. (2084° F.) during 40 minutes in a pusher type sintering furnace under pure nitrogen atmosphere. Before pre-heating the sintered green compact for forging, graphite lubricant is coated on the surface of the sintered green compact to reduce frictions between sintered green compact and forging die wall and to prevent oxidation (or decarburization). Sintered green conpact is pre-heated at 1050° C. (1922° F.) during 30 minutes in a pre-heating furnace for forging. Forging is carried out with pressure of 980 MPa using a 1600 ton mechanical forging press. Thus, a powder metallurgy product is produced.

Obviously, numerous modifications and variations of the present invention are possible in light of the above teachings. It is therefore to be understood that, within the scope of the appended claims, the invention may be practiced otherwise than as specifically described herein.

What is claimed as new and is desired to be secured by Letters Patent of the United States is:

1. A mixture for a powder metallurgy product, comprising:

iron powder including iron grains which contain MnS therein, the mixture containing the MnS of about 0.65 to about 1.40 weight percent;

graphite powder which is contained in the mixture such that an amount of carbon (C) in the powder metallurgy product is about 0.3 to about 0.7 weight percent; and copper (Cu) of about 3.0 to about 5.0 weight percent, wherein an amount (wt % C) of said carbon and an amount (wt % Cu) of said copper is determined to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

2. A mixture according to claim 1, wherein the amount (wt % C) of said carbon and the amount (wt % Cu) of said copper satisfies a relation $$66.63\times(\text{wt \% C})+22.61\times(\text{wt \% Cu})\geqq 102.16$$

and $$22.96\times(\text{wt \% C})+2.99\times(\text{wt \% Cu})\leqq 25.09.$$

3. A mixture according to claim 1, wherein the mixture contains MnS of about 0.65 weight percent to about 1.00 weight percent.

4. A mixture according to claim 3, wherein the mixture contains MnS of about 0.65 weight percent to about 0.90 weight percent.

5. A powder metallurgy product which is made from a mixture, the mixture comprising:

iron powder including iron grains which contain MnS therein, the mixture containing the MnS of about 0.65 to about 1.40 weight percent;

graphite powder which is contained in the mixture such that an amount of carbon (C) in the powder metallurgy product is about 0.3 to about 0.7 weight percent; and copper (Cu) of about 3.0 to about 5.0 weight percent, wherein an amount (wt % C) of said carbon and an amount (wt % Cu) of said copper is determined to obtain a target fatigue strength FS (MPa) and a target hardness HR (HRB) based on a relation $$FS=66.63\times(\text{wt \% C})+22.61\times(\text{wt \% Cu})+280.84$$

$$HR=22.96\times(\text{wt \% C})+2.99\times(\text{wt \% Cu})+78.91.$$

6. A powder metallurgy product according to claim 5, wherein the mixture contains MnS of about 0.65 weight percent to about 1.00 weight percent.

7. A powder metallurgy product according to claim 6, wherein the mixture contains MnS of about 0.65 weight percent to about 0.90 weight percent.

8. A powder metallurgy product according to claim 5, wherein the powder metallurgy product is a forged product which is produced by forging the mixture after being formed to a desired shape under pressure.

9. A method for producing a mixture for a powder metallurgy product, comprising:

pre-alloying MnS in iron grains in iron powder, the mixture containing the MnS of about 0.65 to about 1.40 weight percent;

adding graphite powder to the iron powder such that an amount of carbon (C) in the powder metallurgy product is about 0.3 to about 0.7 weight percent;

adding to the iron powder copper (Cu) of about 3.0 to about 5.0 weight percent;

determining an amount (wt % C) of said carbon and an amount (wt % Cu) of said copper to obtain a target fatigue strength FS (MPa) and a target hardness HR (HRB) based on a relation $$FS=66.63\times(wt\ \%\ C)+22.61\times(wt\ \%\ Cu)+280.84$$

$$HR=22.96\times(wt\ \%\ C)+2.99\times(wt\ \%\ Cu)+78.91.$$

10. A method according to claim 9, wherein the mixture contains MnS of about 0.65 weight percent to about 1.00 weight percent.

11. A method according to claim 10, wherein the mixture contains MnS of about 0.65 weight percent to about 0.90 weight percent.

12. A method for producing a powder metallurgy product, comprising:

producing a mixture during a mixture producing process, the process comprising:

pre-alloying MnS in iron grains in iron powder, the mixture containing the MnS of about 0.65 to about 1.40 weight percent;

adding graphite powder to the iron powder such that an amount of carbon (C) in the powder metallurgy product is about 0.3 to about 0.7 weight percent;

adding to the iron powder copper (Cu) of about 3.0 to about 5.0 weight percent; and determining an amount (wt % C) of said carbon and an amount (wt % Cu) of said copper to obtain a target fatigue strength FS (MPa) and a target hardness HR (HRB) based on a relation $$FS=66.63\times(wt\ \%\ C)+22.61\times(wt\ \%\ Cu)+280.84$$

$$HR=22.96\times(wt\ \%\ C)+2.99\times(wt\ \%\ Cu)+78.91;$$

forming the mixture to a green compact under pressure; and sintering the green compact.

13. A method according to claim 12, further comprising:

forging the sintered green compact.

14. A method according to claim 12, wherein the mixture contains MnS of about 0.65 weight percent to about 1.00 weight percent.

15. A method according to claim 14, wherein the mixture contains MnS of about 0.65 weight percent to about 0.90 weight percent.

16. A powder metallurgy product comprising:

iron including iron grains which contain MnS therein, the product containing the MnS of about 0.65 to about 1.40 weight percent;

carbon (C) of about 0.3 to about 0.7 weight percent; and copper (Cu) of about 3.0 to about 5.0 weight percent, wherein an amount (wt % C) of said carbon and an amount (wt % Cu) of said copper is determined to obtain a target fatigue strength FS (MPa) and a target hardness HR (HRB) based on a relation $$FS=66.63\times(wt\ \%\ C)+22.61\times(wt\ \%\ Cu)+280.84$$

$$HR=22.96\times(wt\ \%\ C)+2.99\times(wt\ \%\ Cu)+78.91.$$

* * * * *

UNITED STATES PATENT AND TRADEMARK OFFICE

CERTIFICATE OF CORRECTION

PATENT NO. : 6,391,083 B1
DATED : May 21, 2002
INVENTOR(S) : Akagi et al.

It is certified that error appears in the above-identified patent and that said Letters Patent is hereby corrected as shown below:

Title page,
Item [73], Assignee information is listed incorrectly. It should read as follows:

-- Item [73] Assignees: Kobelco Metal Powder of America, Inc., Seymour, IN (US); Kobe Steel, Ltd., Kobe; Honda Giken Kogyo Kabushiki Kaisha, Tokyo, both of (JP) --

Signed and Sealed this

Nineteenth Day of November, 2002

*Attest:*

*Attesting Officer*

JAMES E. ROGAN
*Director of the United States Patent and Trademark Office*